US005678324A

United States Patent [19]

Viitaniemi et al.

[11] Patent Number: 5,678,324

[45] Date of Patent: Oct. 21, 1997

[54] METHOD FOR IMPROVING BIODEGRADATION RESISTANCE AND DIMENSIONAL STABILITY OF CELLULOSIC PRODUCTS

[75] Inventors: Pertti Viitaniemi, Helsinki; Saila Jämsä, Espoo; Pentti Ek, Espoo; Hannu Viitanen, Espoo, all of Finland

[73] Assignee: Valtion Teknillinen Tutkimuskeskus, Espoo, Finland

[21] Appl. No.: 545,791

[22] PCT Filed: May 13, 1994

[86] PCT No.: PCT/FI94/00190

§ 371 Date: Nov. 9, 1995

§ 102(e) Date: Nov. 9, 1995

[87] PCT Pub. No.: WO94/27102

PCT Pub. Date: Nov. 24, 1994

[30] Foreign Application Priority Data

| | | | |
|---|---|---|---|
| May 12, 1993 | [FI] | Finland | 932162 |
| May 11, 1994 | [FI] | Finland | 942209 |
| May 11, 1994 | [FI] | Finland | 942210 |

[51] Int. Cl.[6] ..... F26B 7/00

[52] U.S. Cl. ..... 34/396; 34/497

[58] Field of Search ..... 34/396, 411, 412, 34/446, 474, 475, 494, 497

[56] References Cited

U.S. PATENT DOCUMENTS

| | | | |
|---|---|---|---|
| 1,678,559 | 7/1928 | Devine et al. | 34/411 |
| 2,904,893 | 9/1959 | Willey | 34/446 |
| 3,811,200 | 5/1974 | Hager | 34/337 |
| 4,176,464 | 12/1979 | Randolph | 34/412 |
| 4,182,048 | 1/1980 | Wolfe et al. | 34/396 |
| 4,663,860 | 5/1987 | Beall | 34/396 |
| 5,451,361 | 9/1995 | Ruyter et al. | 264/322 |

FOREIGN PATENT DOCUMENTS

| | | |
|---|---|---|
| 784378 | 7/1936 | France . |
| 2263758 | 1/1975 | Germany . |
| 2916677 | 11/1980 | Germany . |
| WO9006840 | 6/1990 | WIPO . |

*Primary Examiner*—John M. Sollecito
*Assistant Examiner*—Steve Gravini
*Attorney, Agent, or Firm*—Sughrue, Mion, Zinn, Macpeak, and Seas

[57] ABSTRACT

A method for improving the resistance of cellulosic products against mold and decay, as well as for enhancing the dimensionally stability of the products is disclosed. The cellulosic products are subjected to heat treatment, which is carried out at an elevated temperature. The products are obtained by drying to a moisture content of less than 15%, and keeping the resulting products in a moist atmosphere at a temperature of at least about 150° C. for 2 to 10 hours until a weight loss of at least 3% has been obtained.

14 Claims, 12 Drawing Sheets

Figure 1:
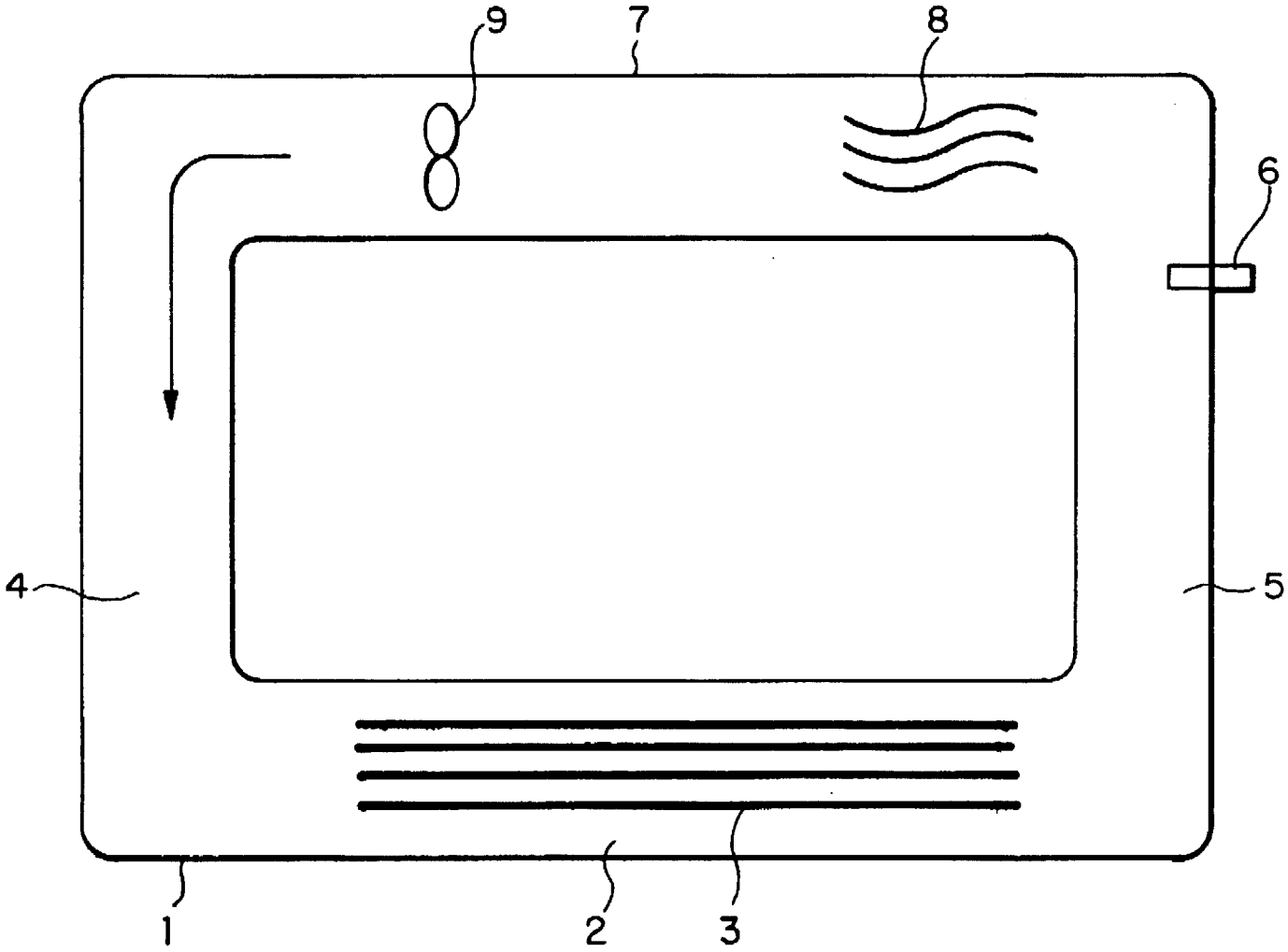

METHOD FOR IMPROVING BIODEGRADATION RESISTANCE AND DIMENSIONAL STABILITY OF CELLULOSIC PRODUCTS

The present invention concerns a method according to the preamble of claim 1 for improving the resistance of cellulosic products against mould and decay as well as to enhance the dimensional stability of the products.

According to a method of the present kind the cellulosic product is subjected to a heat treatment carried out at an elevated temperature.

It is well-known in the art that the dimensional stability of wood can be improved by heat treatments. As far as the prior art is concerned, reference is made to, for instance, the Finnish Patent Specification No. 68,122, which discloses a method for treating wood products at temperatures of 160° to 240° C. and at pressures of 3 to 15 bar. As a result of the treatment, the capability of wood to absorb water and thus to expand is considerably reduced. The effect of heat treatments on decay resistance of wood has also been studied. Mailun, N. P. and Arenas, C. V describe in their article "Effect of heat on natural decay resistance of Philippinean woods" (Philippinen Lumberman, Vol 20, No. 10, 1974, p. 18–19, 22–24) the treatment of Asian wood species in dry state at temperatures of 90°, 110°, 130°, 150° and 175° C. for 240 hours. As a result of the treatment the colour of the wood changes to chocolate brown. An extended treatment at 130°, 150° and 175° C. increased the resistance of the wood samples against two brown rot fungi. However, at the same time it made the wood weaker.

Because all kinds of wood are not suited for the conventional pressure impregnation methods, using substances which prevent the growth and spreading of fungi, heat treatment is an interesting alternative for protecting wood against decay.

The prior heat treatment processes, which call for the use of pressure and extended treatment times, have been too complicated for industrial applicability. It has also been ascertained that under the influence of high pressures and increased temperatures wood becomes brittle and it weakens. Furthermore, wood is easily ignited at high temperatures.

The present invention aims at eliminating the problems related to the prior art and to provide a completely novel solution for improving the dimensional stability of and the resistance against decay and mould (i.e. the biodegradation resistance) of cellulosic products.

The invention is based on the concept of carrying out the heat treatment of the cellulosic product in two stages: first the product is dried to desired moisture content, typically to below 15%. Then the temperature is rapidly raised above 150° C. (typically to about 180° to 250° C.) and the treatment is continued at that temperature until the weight loss of the treated product amounts to at least 3%.

In particular the method according to the invention is principally characterized by what is stated in the characterizing part of claim 1.

As mentioned above, unseasoned timber or similar cellulosic products are used as starting materials for the method according to the present invention. The product can be dried at any suitable conditions (even outdoors at ambient temperature) to the desired moisture content of less than 15%. According to a preferred embodiment of the invention the product is, however, dried at elevated temperatures. The colour of the wood product will become darker during such drying. In connection with the drying due care is taken to avoid cracking of the product. This goal is advantageously attained by constantly determining the temperatures of the interior and the surface, respectively, of the wood and by maintaining the temperature difference at a reasonably small value. Preferably said difference amounts to about 10° to 30° C. This procedure is followed both when the temperature is raised and when it is lowered. Surprisingly, it has been found that said solution will even completely prevent the formation of cracks in (the interior parts of) the wood material. When larger amounts of wood are to be dried several samples should be provided with sensors. On an industrial scale, the preferred procedure comprises determining for each kind of timber a heating programme of its own which takes into account the influence of the initial moisture content on the process.

In order to protect the wood and improve heat transfer during drying it is preferred to use steam during drying. According to a preferred embodiment, the drying process according to the invention comprises the following steps:

a) first the temperature of the drying oven is raised to at least about 90° C., preferably to at least 100° C., and that temperature is maintained until the wood has at least approximately reached the same temperature, b) then the temperature of the oven is gradually raised so that the difference between the interior temperature of the wood and the temperature of the oven does not exceed 30° C. until the desired moisture content of the wood is reached, and c) finally, the temperature of the oven is lowered gradually while ensuring that the difference between the temperature of the interior parts of the wood and the temperature of the oven does not exceed 30° C. until the interior of the wood has reached the desired temperature.

If needed, stage c can be left out. The heat treatment, which will be described in more detail below, is then carried out immediately after stage b.

During the first stage of the present invention (step a), the temperature of the drying oven is preferable set at a value of about 100° to 150° C., preferably 100° to 120° C. In the second stage (step b), the heating is stopped when the humidity of the wood is below 15%, e.g. 1 to 15%. During step b and step c, if any, the difference between the external temperature and the interior temperature of the cellulosic product is kept at a value of 10° to 30° C. Too small a temperature difference prolongs the drying process, whereas too large a difference increases the risk of internal cracking. During stage c the temperature of the oven is lowered until the interior temperature of the wood has decreased below 100° C.

During stages a, b, and c water steam is fed into the oven to keep the wet temperature at about 80° to 120°, preferably at about 100° C. It is preferred to use saturated water steam.

When the moisture content of the product has dropped to below 15%, as a result of the drying, the treatment is continued at an elevated temperature.

During the second stage of the process the temperature is kept higher than during the first stage of the process. It is preferred to operate the process at about 180° to 250° C. in an atmosphere of saturated steam. The temperature can also be raised during the second stage, as will appear from Example 2. The duration and the temperature of the treatment are interdependent, as explained in connection with Example 1. Typically, the heat treatment of the second stage takes at least some 0.5 hours, preferably 1 to 20 hours and in particular about 2 to 10 hours. The weight loss of the product can be adjusted by varying the heat treatment. This makes it possible to change the strength and decay resistance properties of the product as desired. Therefore, the heat treatment is continued until a weight loss of at least 3% (based on dry matter) has been obtained. Clear improvements of the dimensional stability of the product are reached at this value already. Mould and decay resistance will also be improved, and further improvements of said properties can be obtained by continuing the heating until at least a about 5%, preferably at least a 6 or even a 8%, weight loss has taken place in the product.

Summarizing, the features obtained by the present invention are:

Improvement of decay resistance (in comparison to wood which natively has a good resistance to decay)

Improvement of mould resistance

Improvement of the dimensional stability

Removal of pitch

Heat conductivity decreased by 25–40%

Improvement of paint adherence

The heat treatment of the second stage is, according to a preferred embodiment of the invention, carried out at least essentially under non-pressurized conditions, i.e. at atmospheric pressure.

The method according to the invention is suited for treatment massive wood goods, such as logs and pillars. In addition, the method can be applied to veneer, chips, saw dust, wood fibres and other cellulosic products, such as, for instance, crates.

The wood preservation effect that can be produced is studied in more detail in Example 2. However, in this connection it should be pointed out that good protection against decay requires that dried sawn timber of pine is kept for preferably about 2 to 8 hours at a temperature of 200° to 250° C. The same conditions are used for birch and larch-tree, whereas good protection against decay can be obtained at slightly lower temperatures for spruce. Thus, spruce can be treated, for instance, at about 175° to 210° C. The method is well-suited for treatment of aspen.

Example 3 explains in detail the decrease of heat conductivity as a result of a treatment carried out according to the invention.

The invention provides considerable advantages. It will therefore provide for a shortening of the time required for drying of wood. The colour changes appearing during drying can be utilized and, at the same time, the resistance of wood against decay and mould and the dimensional stability can be improved. Detrimental pitch can be removed from samples of coniferous wood by the treatment. As examples of products that can be treated with the method according to the present invention, the following can be mentioned: external cladding, window frames, outdoor furniture, and boards for sauna platforms.

After a treatment according to the present invention, the dimensional instability under the influence of moisture is reduced by 50 to 70%. The resistance against decay of the products is improved. At its best, the resistance is on the same level as that obtained by pressure impregnation or even better without any substantial weakening of the strength properties of the products. The treated wood forms a good surface for paint.

The preparation process is simple and quick (short treatment times) and there is no need to use pressure. As far as its weathering resistance, resistance to decay and mould, and strength properties are concerned, the product can be modified in a controlled manner by the method. The method is suitable for all kinds of wood. By means of the heat treatment it is become possible also to improve the properties of the heartwood, which cannot be done by pressure impregnation. The durability of those kinds of wood which are difficult to impregnate can be improved. The improvement of the permeability of wood makes it possible to impregnate the wood with other colouring agents.

In the following the invention will be examined in greater detail with the help of the attached drawings and some working examples.

Figure 2:
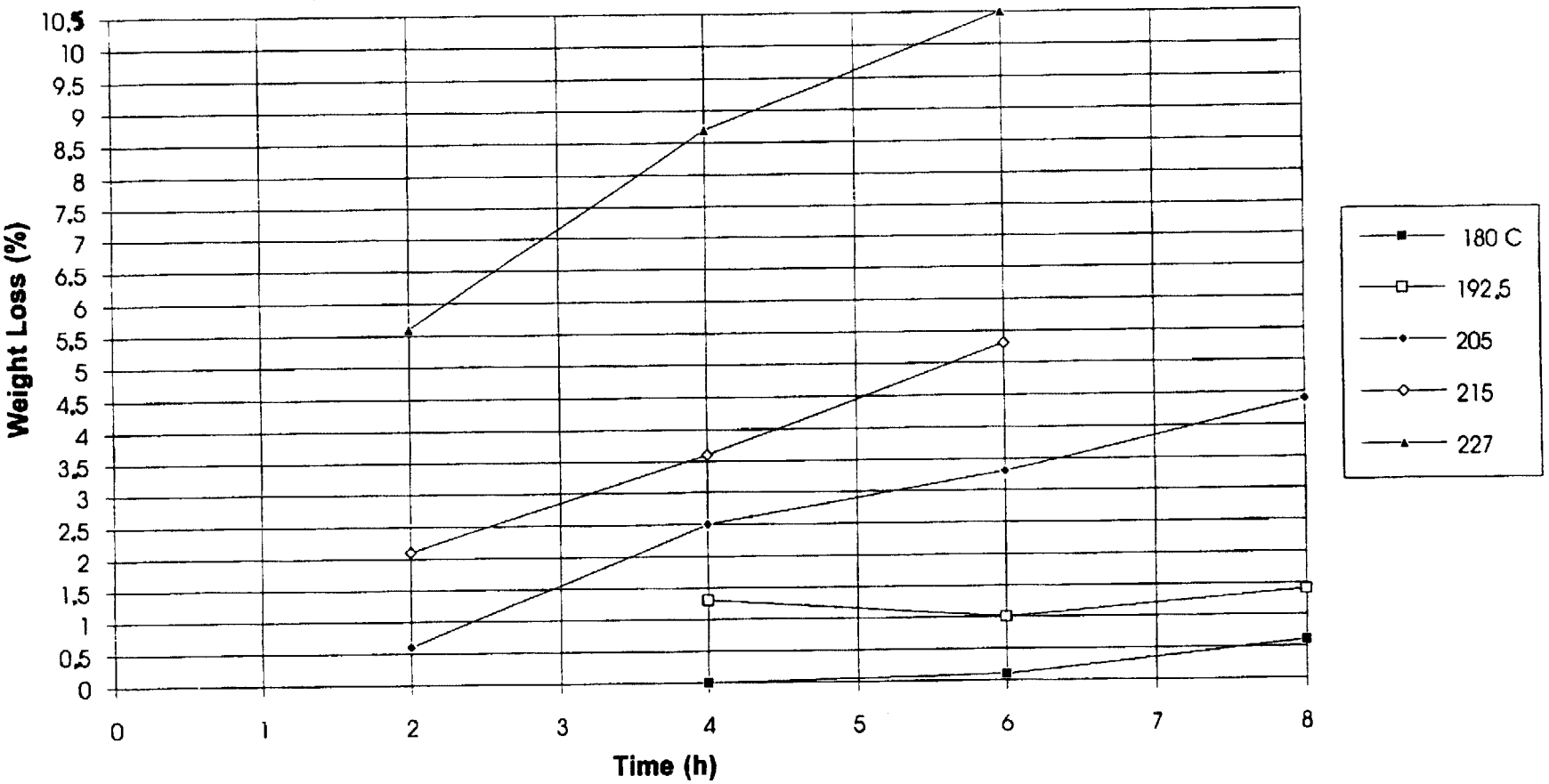
Figure 3:
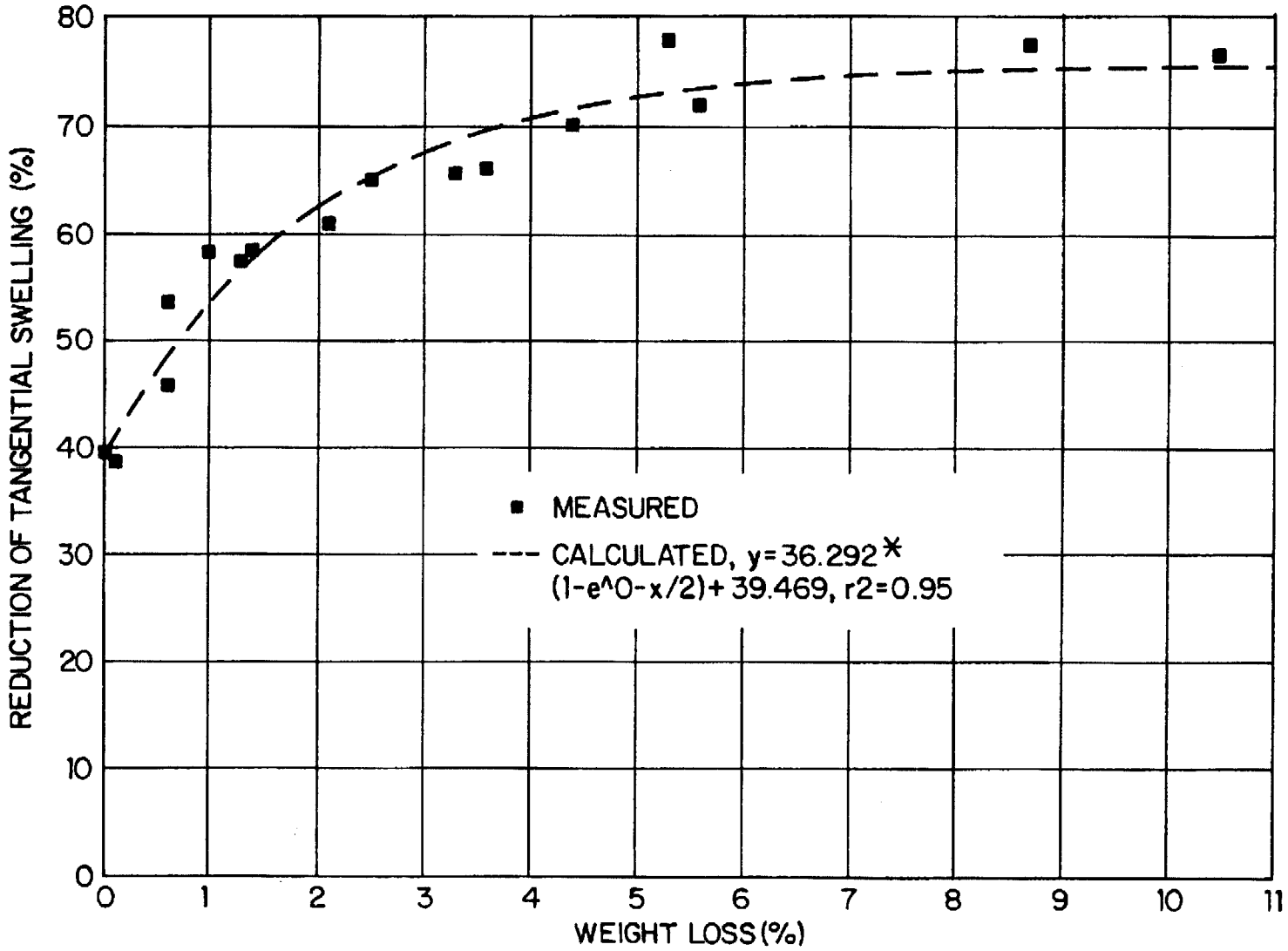
Figure 4:
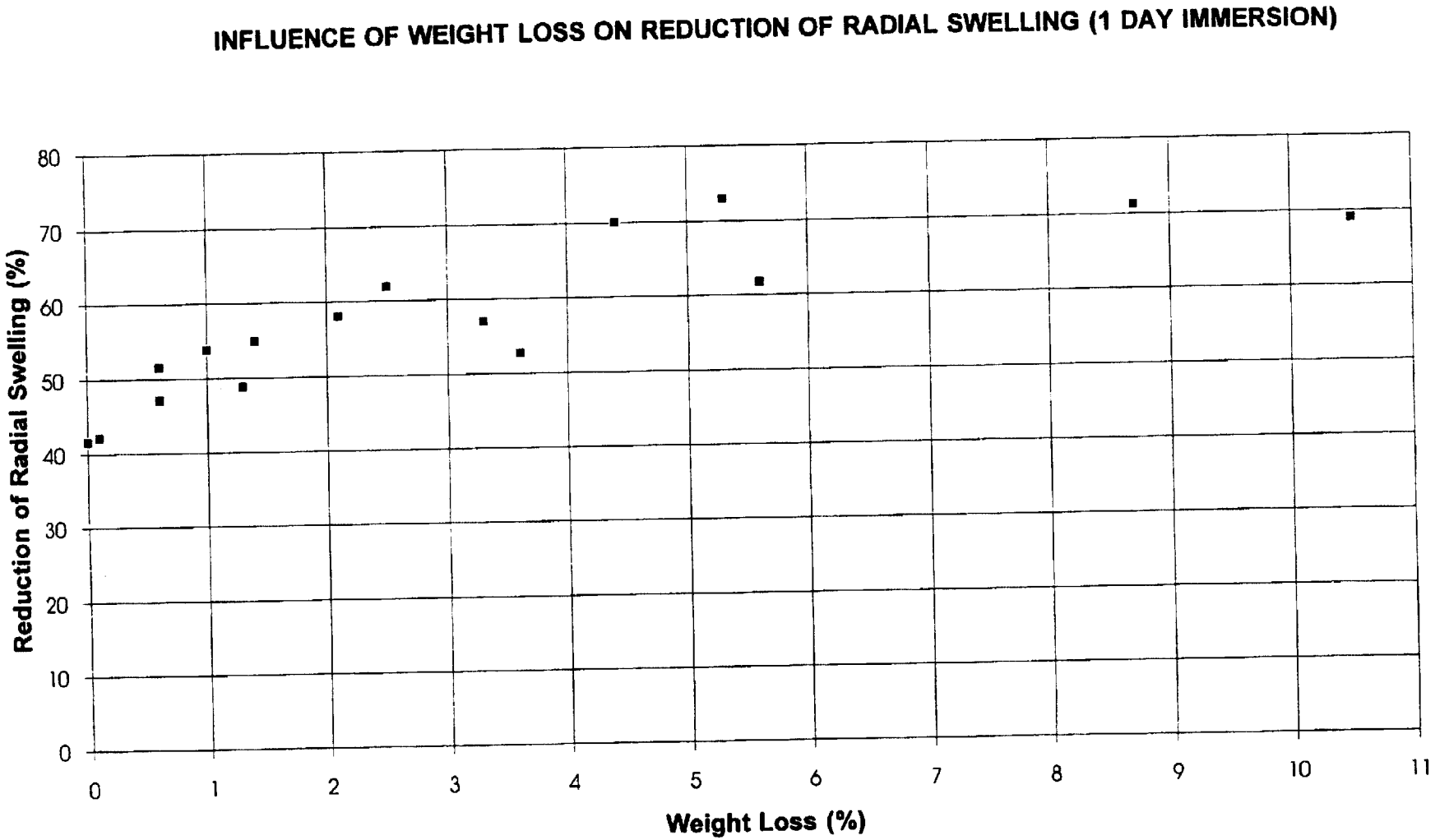
Figure 5:
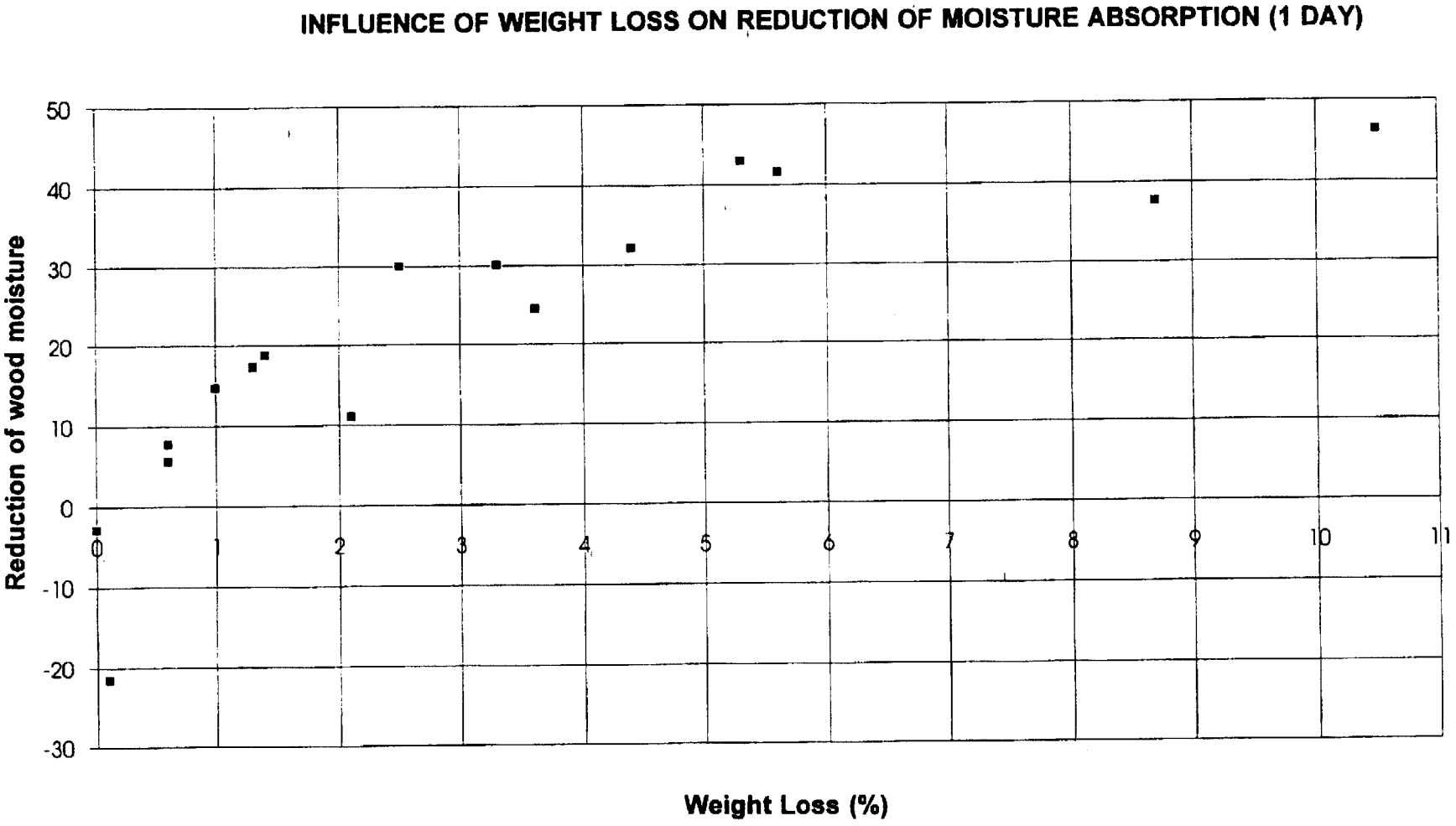
Figure 6:
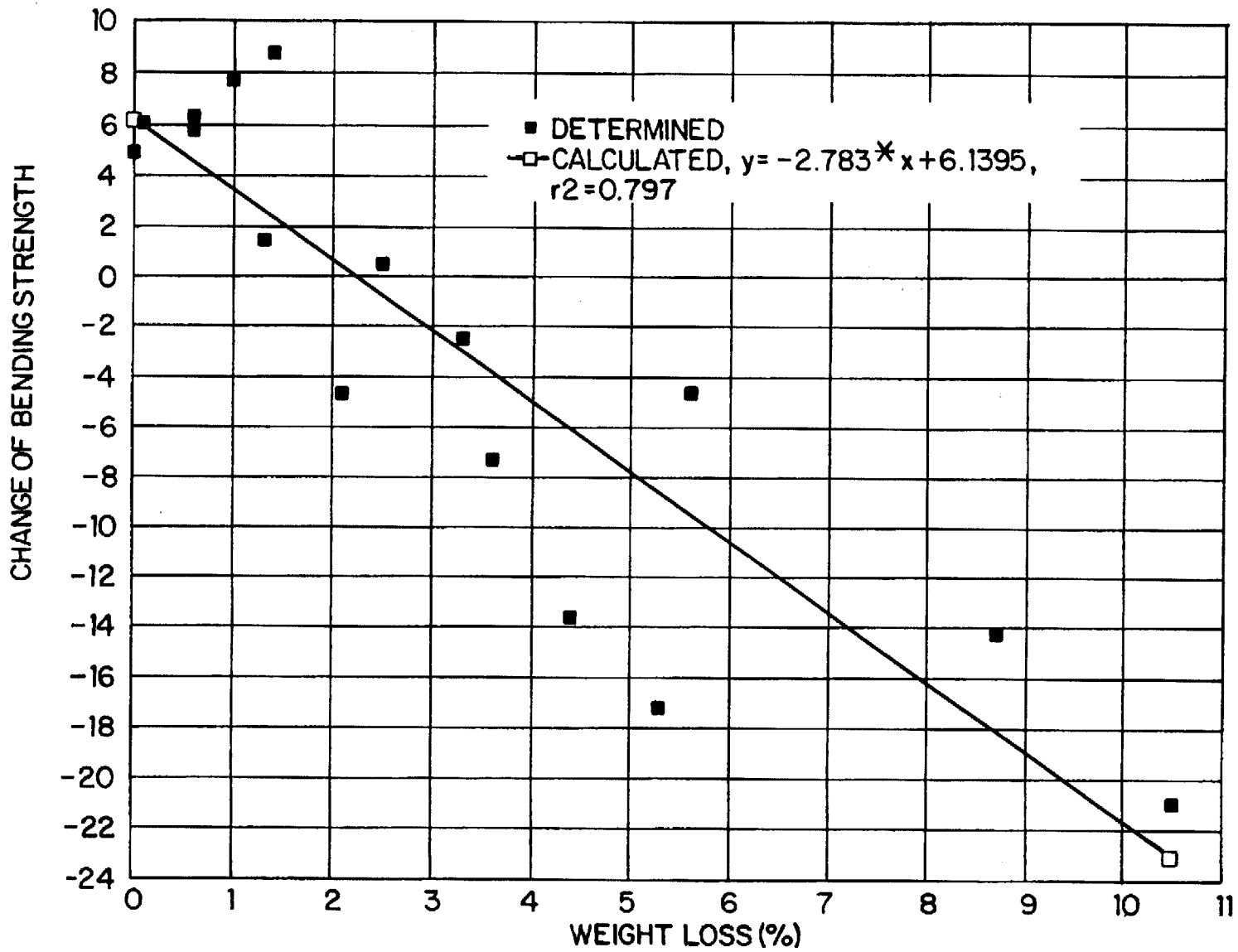
Figure 7:
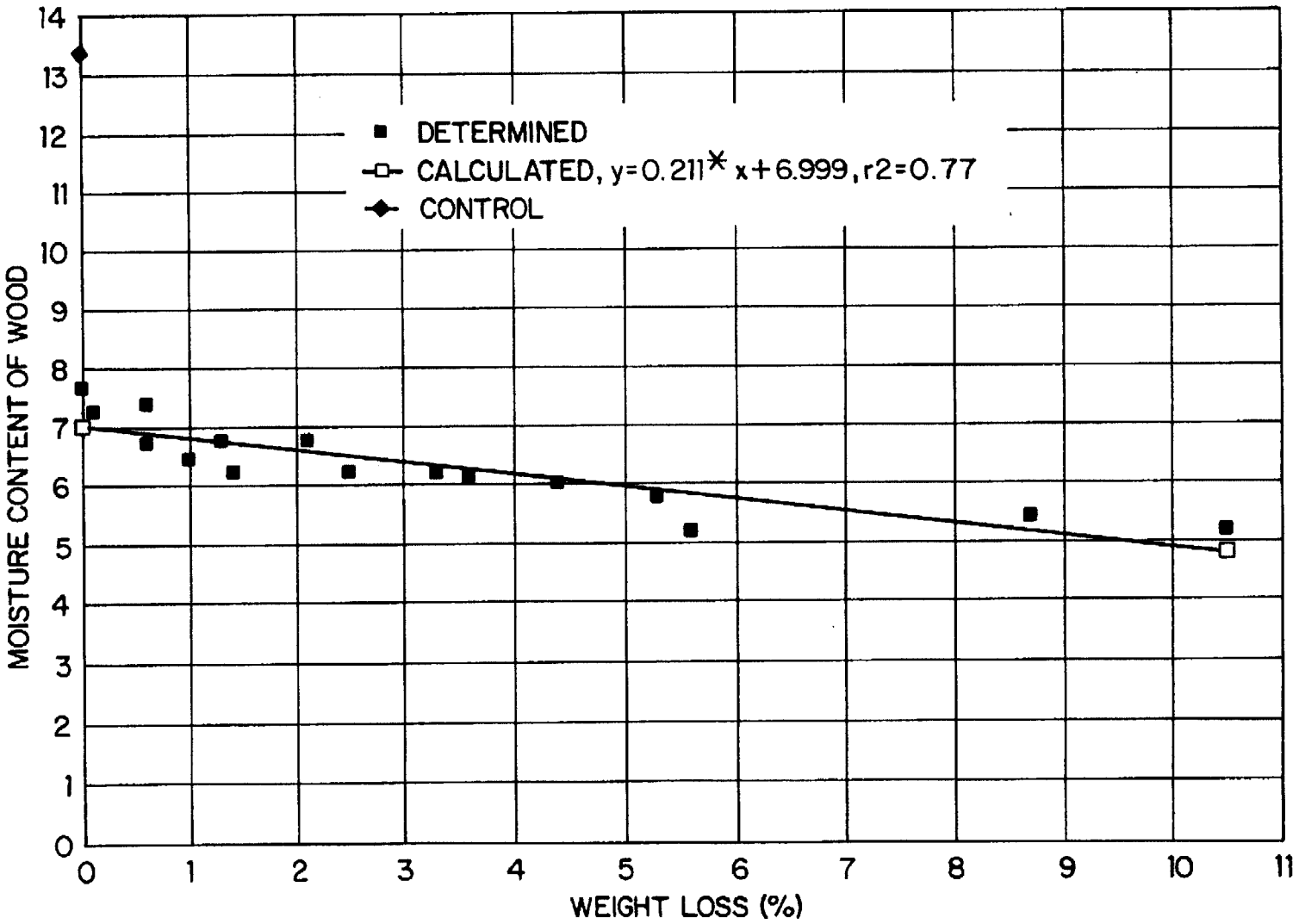
Figure 8:
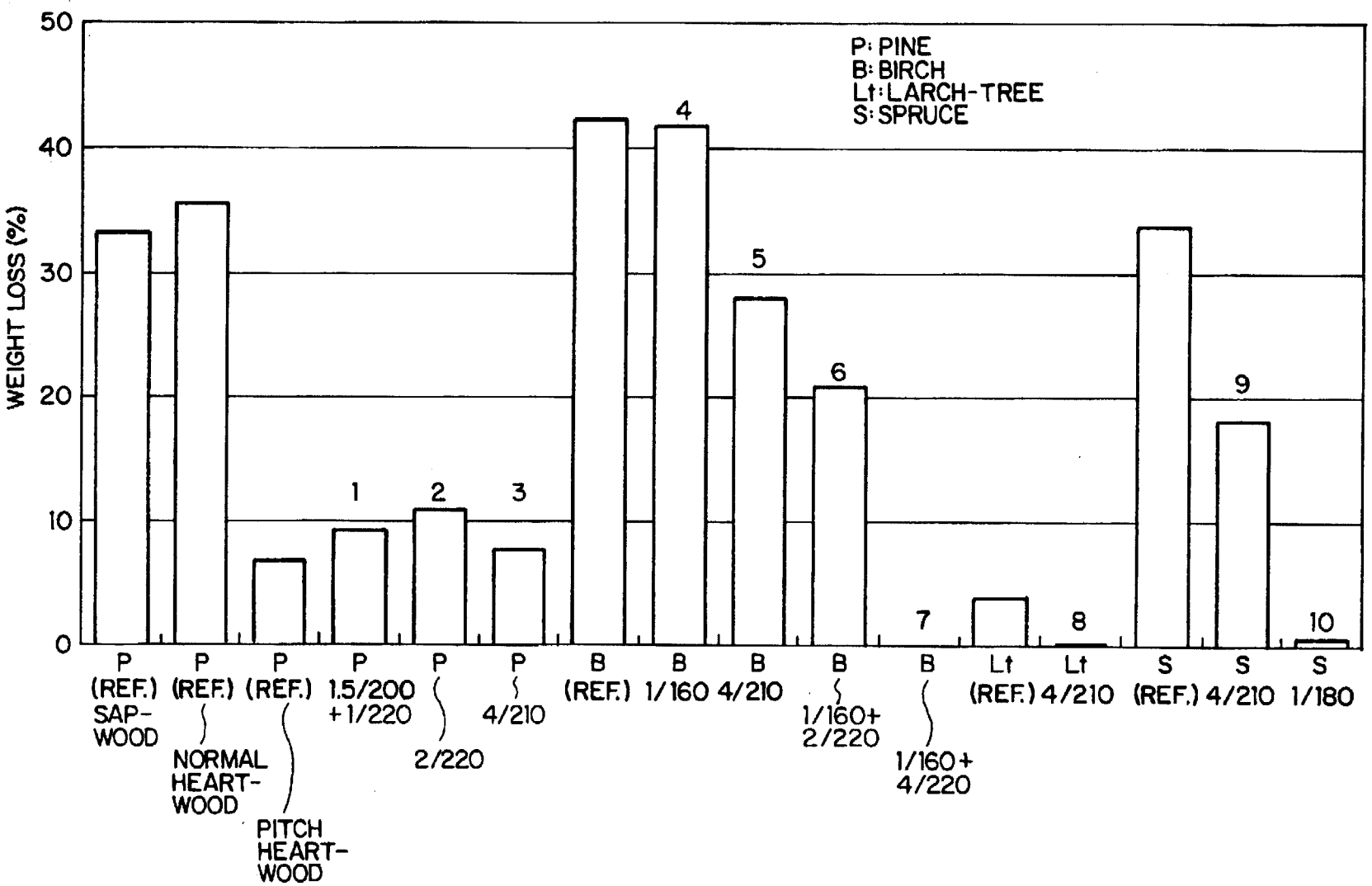
Figure 9:
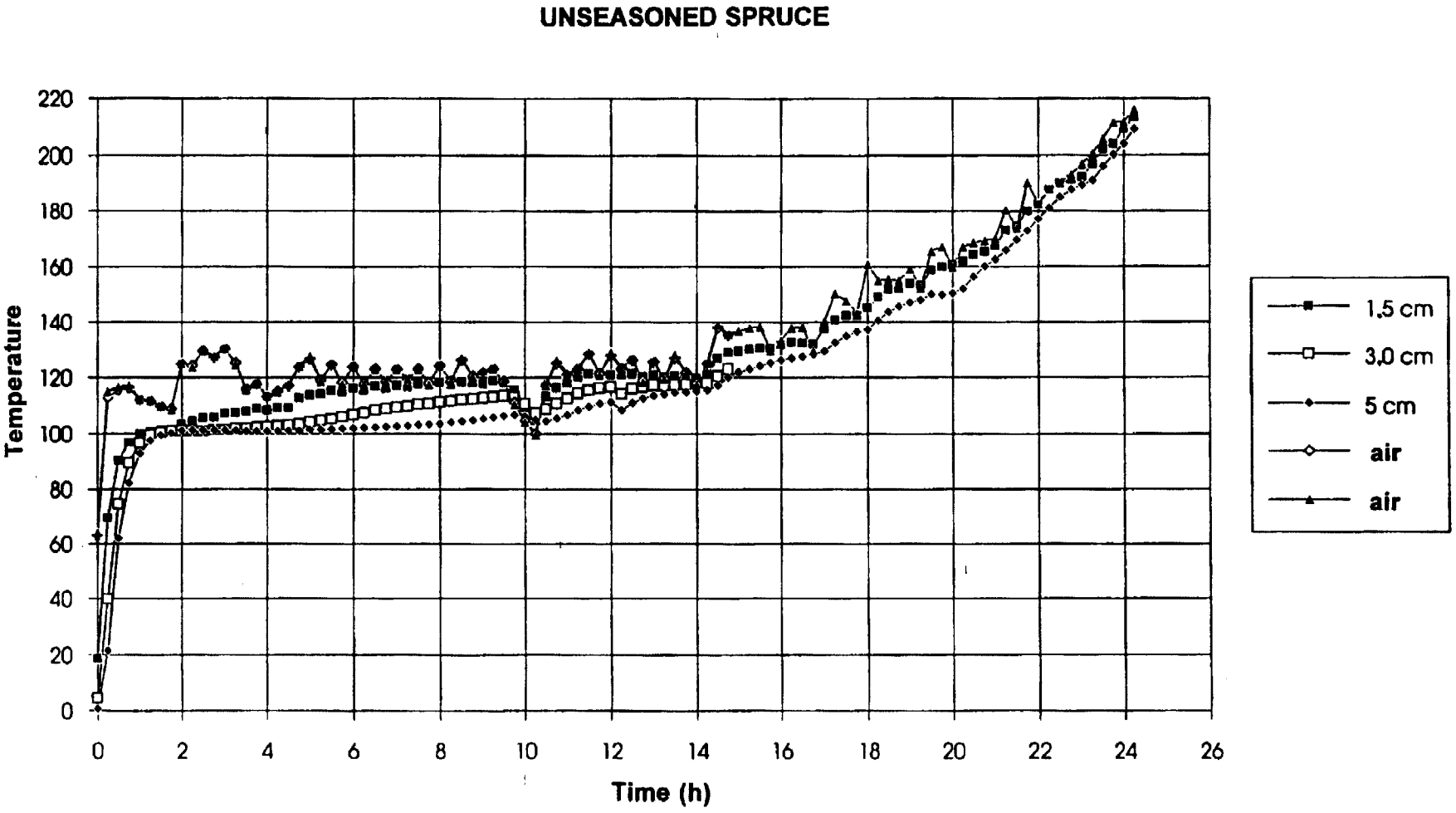
Figure 10:
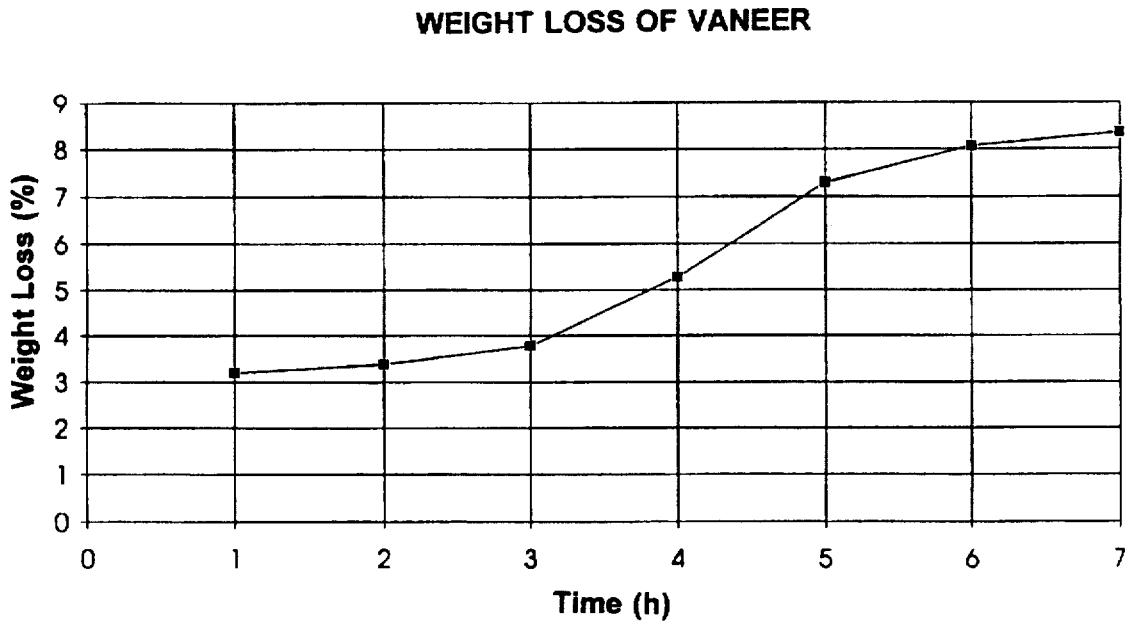
Figure 11:
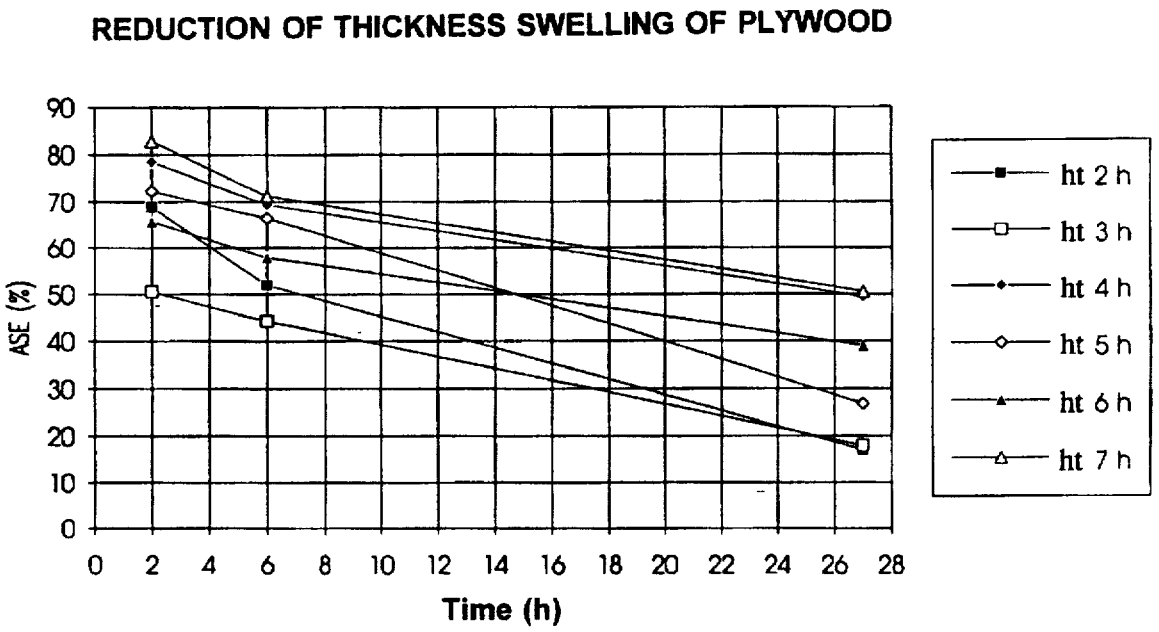
Figure 12:
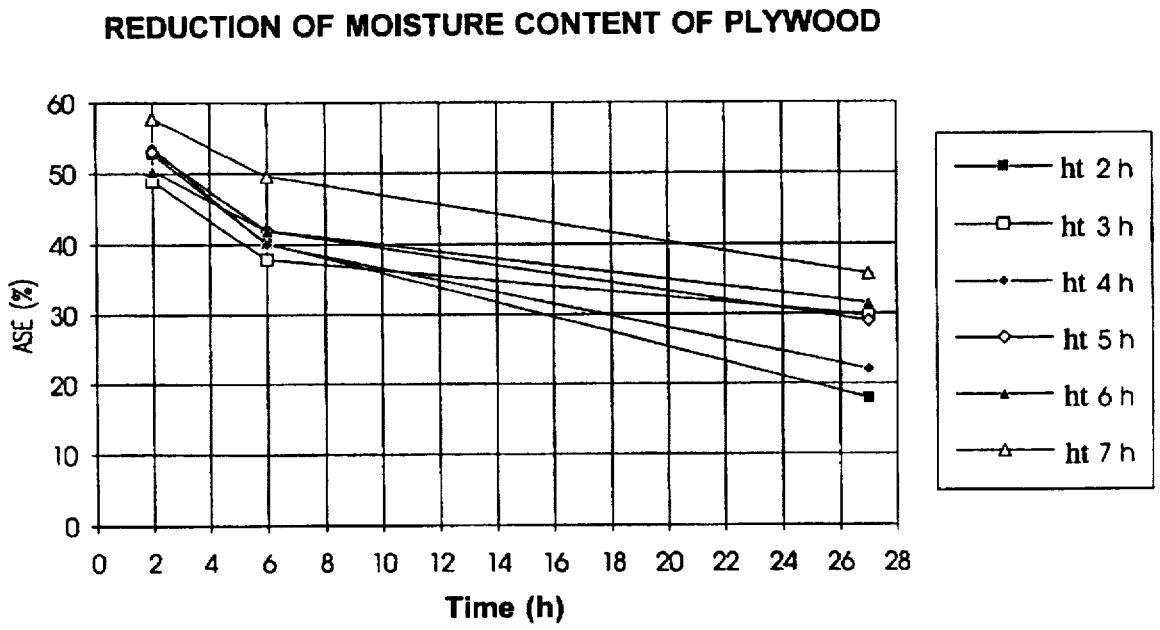

FIG. 1 is a simplified schematic representation of the construction of an apparatus which can be used for carrying out the present invention, FIG. 2 indicates the influence of the temperature and treatment time on the weight loss of the product, FIG. 3 indicates the reduction of tangential swelling of the wood sample as a function of the weight loss, FIG. 4 indicates the reduction of radial swelling of the wood sample as a function of the weight loss, FIG. 5 indicates the reduction of moisture taken up by the wood sample as a function of the weight loss, FIG. 6 indicates the changes of bending strength caused by the heat treatment, FIG. 7 shows the moisture contents of bending test samples after conditioning for 4 weeks, FIG. 8 shows the weight losses of heat treated and control samples, respectively, after decay testing, FIG. 9 shows the drying of unseasoned spruce according to a preferred embodiment according to the present invention, FIG. 10 indicates the weight losses of veneer as a function of the duration of the heat treatment, FIG. 11 indicates the reduction of thickness swelling of plywood as a result of a heat treatment, and FIG. 12 indicates the reduction of the moisture content of plywood under the influence of a heat treatment.

An apparatus shown, for instance, in FIG. 1 is used in the present invention. The apparatus comprises an oven 2 surrounded by an oven jacket 1. The samples 3 are placed in the oven, which is provided with inlet 4 and outlet 5 channels for air 5, for conducting moist air through the oven. The outlet channel 5 is combined with a steam feed pipe 6 for feeding more water steam into the outlet air coming from the oven. In order to form a closed cycle the inlet and outlet channels are joined each to its end of a set of ducts 7 provided with a fan 9 and with heating means 8. The air flowing through said ducts are heated by electric resistances 8 to the set temperature and conducted via the fan 9 to the inlet channel 4 of the oven. The recycling direction of the air in the apparatus is indicated with an arrow.

By using the present apparatus it is possible to make sure that the samples placed in the oven are heated to the desired temperature by moist air. By changing the amount of steam, which is being fed, the moisture content of the air can be altered. Usually, the air of the oven is saturated with water steam.

EXAMPLE 1

Heat treatment of wood

Moist wood is dried in the above-described apparatus at 120° to 140° C. either with steam or without it. As a result of the treatment, there is some darkening of the colour of the wood sample, but no cracking. When the moisture content of the wood is below 15% the temperature is raised to at least 175° C., preferably to 180° to 250° C. The treatment is continued for 2 to 10 hours. Saturated steam is conducted to the apparatus. By varying the temperature and the time, the desired result can be obtained. The colour of the wood darkens further.

FIG. 2 shows the influence of temperature and time on the reduction of wood weight.

By adjusting the weight losses the properties of the wood can be changed as desired. FIGS. 3, 4 and 5 depict the reduction of tangential swelling of the wood, the reduction of the radial swelling of the wood, and the reduction of the amount water absorbed by the wood (wood moisture content) in comparison to the control samples. The graphs of FIGS. 4 and 5 correspond to graph model of FIG. 1.

The heat treatment weakens the bending strength of wood after a certain weight loss. On the other hand, the experiments show that the bending strength properties of some of our samples were even better than the corresponding properties of the control samples (FIG. 6). This is due to the fact that, depending on ambient humidity, some of the heat treated samples clearly adsorbed less water than the control sample (FIG. 7).

EXAMPLE 2

Decay test

The decay test was carried out according to European Standard EN 113 modified as follows: the number of parallel test specimens was four, the sizes of the test specimens were 5×20×35 mm, and they were not rinsed before the test. The samples were subjected to the test rot fungus, cellar fungus (*Coniophora puteana*), for 2, 4, 8, and 12 weeks.

The test specimens were sawn from planks of pine, birch, larch-tree and spruce, treated according to example 1. Table 1 contains a summary of the conditions prevailing during the heat treatment.

TABLE 1

Treatment conditions of the test specimens of the decay test

| Sample | Wood species | Heat treatment (time/temp.) |
|---|---|---|
| 1 | Pine | 1.5 h/200° C. + 1 h/220° C. |
| 2 | Pine | 2 h/220° C. |
| 3 | Pine | 4 h/210° C. |
| 4 | Birch | 1 h/160° C. |
| 5 | Birch | 4 h/210° C. |
| 6 | Birch | 1 h/160° C. + 2 h/220° C. |
| 7 | Birch | 1 h/160° C. + 4 h/220° C. |
| 8 | Larch-tree | 4 h/210° C. |
| 9 | Spruce | 4 h/210° C. |
| 10 | Spruce | 1 h/180° C. |

After the heat treatment the dry matter of the wood specimens were determined. The test specimens were sterilized by radiation (Co-60), the sterilized test specimens were inserted in kolle dishes on a fungus culture growing on malt agar medium. At least one heat treated test specimen and one untreated control sample were inserted into each dish.

At the end of the decay test the specimens were dried at 103° C. and the weight losses of the specimens were calculated according to EN 113. For pine a weight loss of less than 10% was achieved by the heat treatment; the weight losses for untreated wood were over 30%. The smallest weight losses for heat treated birch, larch-tree and spruce were close to zero.

The results of the decay tests are indicated in FIG. 8. It is apparent from the figure that a mild heat treatment (160° C.) does not yet significantly improve the decay resistance of the timber.

EXAMPLE 3

Drying of unseasoned spruce

When a specimen of wet spruce (50×100×1500 mm), initial moisture content about 40%, was heated according to the preferred drying embodiment of the invention for 24 hours by operating the drying system in such a way that the difference between the internal and external temperatures was 10 to 20 degrees, no cracks were found in the test specimen (FIG. 9). The final moisture of the dry test specimen was below 5%.

EXAMPLE 4

Reduction of heat conductivity

Table 2 presents the heat conductivities of heat treated samples of spruce, pine and aspen. The table also indicates the conditions of the heat treatment.

TABLE 2

Heat conductivity of the test specimens

| Wood/treatment, temperature and time | Density at time of measuring, kg/m³ | Heat conductivity $\lambda_{10}$, W/(mK) |
|---|---|---|
| Aspen, control | 415 | 0.098 |
| Aspen, 4 h 210° C. | 403 | 0.077 |
| Aspen, 10 h 210° C. | 379 | 0.077 |
| Spruce, control | 497 | 0.11 |
| Spruce, fresh, 26 h, heat treatment: 3 h/ 220° C. | 375 | 0.086 |
| Spruce, 8 h 230° C. | 399 | 0.080 |
| Pine, control | 583 | 0.13 |
| Pine, fresh, heat treatment: 3 h 220° C. | 520 | 0.107 |
| Pine, 30 h 230° C. | 476 | 0.088 |

EXAMPLE 5

Birch veneer, thickness 1.5 mm, was heat treated in an oven of the kind shown in FIG. 1. The temperature of the treatment was 200° C. and the time 2 to 7 hours.

The test specimens were selected by dividing the veneer into two parts and by choosing one half of the veneer as a control. The other half was heat treated. A 3-ply plywood was prepared from the veneer. The gluing was made by FF glue, which was applied to the surfaces of the veneer by a brush. The veneers were pressed together at 130° C. for 6 minutes. The compression load was 1.7 MPa. The control plywood and the plywood prepared from the heat treated veneers were kept in the same pressing.

In order to determine the thickness swelling, the test specimens were dried in an oven at 102° C. Then they were immersed into 20° C. water for 2, 6, 26, and 168 hours. The test specimens were prepared for the strength testing by conditioning them at a relative humidity of 65%, wherein-after they were evaluated for wood failure, tensile strength and bending strength. The tests included two parallel test specimens.

The weight loss of the wood (calculated on basis of the dry matter) caused by the heat treatment is indicated in FIG. 10. As a result of the treatment the weight of the wood decreased by 3.4 to 8.4%.

The thickness swelling of the plywood is indicated in FIG. 3.

TABLE 3

| Thickness swelling of plywood and moisture content of plywood after immersion into water | | | | | | | | |
|---|---|---|---|---|---|---|---|---|
| | Thickness swelling | | | | Moisture content | | | |
| Sample | 2 h | 6 h | 27 h | 168 h | 2 h | 6 h | 27 h | 168 h |
| 2 h heat | 2.9 | 5.5 | 10.2 | 11.7 | 18.0 | 29.6 | 50.0 | 79.1 |
| 2 h control | 9.1 | 11.4 | 12.3 | 12.5 | 38.0 | 49.5 | 60.8 | 72.3 |
| 3 h heat | 2.7 | 5.2 | 8.9 | 11.0 | 14.8 | 27.0 | 43.2 | 74.8 |
| 3 h control | 5.5 | 9.3 | 10.9 | 11.1 | 28.8 | 43.5 | 61.4 | 75.9 |
| 4 h heat | 1.8 | 3.7 | 7.4 | 9.9 | 13.4 | 23.6 | 42.0 | 74.2 |
| 4 h control | 8.6 | 11.9 | 14.5 | 14.7 | 28.8 | 39.3 | 53.9 | 66.5 |
| 5 h heat | 1.9 | 4.1 | 8.0 | 11.2 | 16.1 | 27.4 | 46.6 | 79.9 |
| 5 h control | 6.8 | 12.2 | 10.9 | 11.1 | 34.1 | 47.3 | 65.6 | 78.7 |
| 6 h heat | 1.8 | 3.6 | 6.3 | 8.6 | 14.5 | 25.1 | 43.0 | 77.2 |
| 6 h control | 5.4 | 8.6 | 10.4 | 10.6 | 29.1 | 43.3 | 62.8 | 79.0 |
| 7 h heat | 1.2 | 2.8 | 5.5 | 7.9 | 13.2 | 22.2 | 38.0 | 67.5 |
| 7 h control | 6.7 | 9.7 | 11.1 | 11.2 | 31.2 | 48.8 | 59.1 | 73.7 |

The thickness swelling of the control samples varied to a large extent. For this reason, the swelling reduction results presented in FIG. 11 have been calculated in relation to the control samples of each test series. FIG. 12 shows the reduction of the amounts of water absorbed by the wood samples compared to the untreated samples.

As far as thickness swelling is concerned the best results were obtained by the treatment having the longest duration, i.e., by a 7 hour heat treatment. After a 2 hour immersion the thickness swelling was then 80% smaller than that of the control samples. An almost equally good a result was reached by a 4 hour treatment. 2 and 3 hour heat treatments reduced thickness swelling after a 2 hour immersion to 50 or 70%. After a 24 hour immersion the thickness swelling of plywood which had been heat treated for 7 and 4 hours was 50% smaller than that of the control samples.

The heat treatment reduces the amount of water absorbed by the wood sample (=moisture content of wood). Subject to immersion into water for 24 hours, the moisture content of plywood which had been heat treated for 7 hours was about 38 smaller than that of the control plywood.

Table 4 indicates the strength properties of the plywood articles.

TABLE 4

| Strength properties of the plywood | | | | | |
|---|---|---|---|---|---|
| | Shear strength of glue line | | | Moisture content (%) | |
| Sample | Wood failure % | Resist. to shear N/mm² | Tensile strength N/mm² | during strength testing | Bending strength/ mm² |
| 2 h heat | 21 | 1.7 | 65.3 | 5.0 | 132 |
| 2 h control | 97 | 3.0 | 81.7 | 5.3 | 148 |
| 3 h heat | 81 | 2.4 | 83.1 | 4.7 | 155 |
| 3 h control | 98 | 3.0 | 101.7 | 4.1 | 148 |
| 4 h heat | 99 | 2.2 | 55.4 | 5.2 | 130 |
| 4 h control | 95 | 3.0 | 110.9 | 5.0 | 165 |
| 5 h heat | 100 | 1.7 | 50.4 | 4.2 | 95 |
| 5 h control | 84 | 3.1 | 74.5 | 4.7 | 128 |
| 6 h heat | 99 | 1.9 | 37.5 | 4.5 | 108 |
| 6 h control | 77 | 2.4 | 92.8 | 4.9 | 139 |
| 7 h heat | 97 | 1.8 | 55.2 | 4.9 | 101 |
| 7 h control | 94 | 2.9 | 84.5 | 5.4 | 141 |

Requirements for a 3-ply plywood:

Shear strength of glue line, dry, strength=2.1N/mm². If the strength is less than that, the wood failure percentage should be more than or equal to 50%.

Tensile strength 54N/mm²

Bending strength 72N/mm²

The tensile strength of plywood prepared from heat treated veneer was almost always less than the required 2.1, but because the wood failure % exceeded 50, it should be noted that the requirements regarding shearing strength were nevertheless fulfilled.

The bending strength of the plywood prepared from heat treated veneer was inferior to that of the control plywood, but even so it met the requirements. The required bending strength was not reached with heat treated veneer which had been heat treated for 5 or 6 hours.

EXAMPLE 6

Field trials

Test specimens (50×25×500 mm) were heat treated for 4 hours at 220° C. The samples were placed on test field in contact with the earth. After a time of one year the test specimens were checked and evaluated.

The results were evaluated using the following scale: 1=some beginning decay (25%), 2=50%, 3=75%, 4=the test specimen breaks under a weight. Average values of the results:

Pine, control=0.3. Heat treated pine=0.

Spruce control=1. Heat treated spruce=0.2.

Birch, control=3.6. Heat treated birch=2.5.

We claim:

1. A method for increasing the resistance of a cellulosic product against mold and decay and for improving the dimensional stability of said product comprising the steps of:

(A) subjecting a wet cellulosic product to a heat treatment so as to reduce the moisture content of the product to less than 15%; and (B) subjecting the resulting cellulosic product of step (A) to an atmosphere saturated with steam at a temperature above 150° C. so as to reduce the weight of the product at least 3% by decomposition of wood components present in the cellulosic product.

2. The method according to claim 1, wherein during step (A), the difference between the inner temperature of said product and the outer temperature of said product is maintained at about 10° to 30° C. so as to prevent cracking.

3. The method according to claim 2, wherein step (A) is carried out in the presence of steam.

4. The method according to claims 2 or 3, wherein step (A) comprises the steps of:

(i) placing said product in a drying oven, wherein the temperature of said oven is raised to at least 90° C., and wherein said oven is kept at said temperature until said product has at least approximately reached said temperature, (ii) gradually increasing the temperature of said oven while maintaining the difference between the inner temperature of said product and the temperature of said oven at less than 30° C. until the desired moisture content of the product has been reached, and optionally, (iii) gradually lowering the temperature of said oven while maintaining the difference between the inner temperature of said product and the temperature of said oven at less than 30° C. until the inner temperature of said product has reached the desired temperature.

5. The method according to claim 4, wherein the temperature of said oven is raised to at least 100° C.

6. The method according to claim 1, wherein step (A) is carried out at 180° to 250° C. for 1 to 20 hours.

7. The method according to claim 6, wherein step (A) is carried out for about 2 to 10 hours.

8. The method according to claim 1, wherein step (A) is carried out essentially under non-pressurized conditions.

9. The method according to claim 1, wherein said cellulosic product is selected from the group consisting of wood pillars, wood logs, sawn wood, wood veneer, plywood, wood chips, saw dust and wood fibers.

10. The method according to claim 9, wherein said cellulosic product is pine wood, and wherein in step (B), said pine wood is subjected to a temperature of 200° to 250° C. for 2 to 8 hours so as protect against decay.

11. The method according to claim 9, wherein said cellulosic product is spruce wood, and wherein in step (B), said spruce wood is subjected to a temperature of 175° to 210° C., for 2 to 8 hours so as to protect against decay.

12. The method according to claim 9, wherein the cellulosic product is birch wood, and wherein in step (B), said birch wood is subjected to a temperature of 200° to 250° C., for 2 to 8 hours so as to protect against decay.

13. The method according to claim 9, wherein the cellulosic product is larch-tree wood, and wherein in step (B), said larch-tree wood is subjected to a temperature of 200° to 250° C., for 2 to 8 hours so as to protect against decay.

14. The method according to claim 1, wherein in step (B), the weight of the product is reduced at least about 5%.

* * * * *